US006567992B2

(12) United States Patent
Ross

(10) Patent No.: US 6,567,992 B2
(45) Date of Patent: May 27, 2003

(54) SEAMOBILE SAFETY BELT

(76) Inventor: William Ross, 77 Eileen Ave., Toronto Ontario (CA), M6N 1V8

( * ) Notice: Subject to any disclaimer, the term of this patent is extended or adjusted under 35 U.S.C. 154(b) by 0 days.

(21) Appl. No.: 10/011,398

(22) Filed: Dec. 11, 2001

(65) Prior Publication Data

US 2003/0070205 A1 Apr. 17, 2003

Related U.S. Application Data

(60) Provisional application No. 60/328,420, filed on Oct. 12, 2001.

(51) Int. Cl.[7] ..... A41F 9/00

(52) U.S. Cl. ..... 2/311; 2/312; 182/3

(58) Field of Search ..... 2/322, 312, 319, 2/318, 317, 321, 311, 337, 320, 314, 315; 280/290; 294/25, 140, 152, 156, 158; 180/268, 273; 441/108, 113, 123, 111, 106, 114, 115, 117, 119, 120, 122; 182/3; 119/497

(56) References Cited

U.S. PATENT DOCUMENTS 1,579,420 A * 4/1926 Welch ..... 294/152
3,562,812 A * 2/1971 Greggains ..... 182/3
3,896,499 A * 7/1975 Kelly ..... 2/311
4,028,742 A * 6/1977 Marquis ..... 2/300
4,411,222 A * 10/1983 Wolfson ..... 2/300
4,413,358 A * 11/1983 Jimenez ..... 2/311
4,944,057 A * 7/1990 Shaw ..... 5/89.1
5,081,719 A * 1/1992 Donnelly ..... 182/3
5,152,013 A * 10/1992 Johnson ..... 2/311
5,297,834 A * 3/1994 Vanarnem ..... 294/140
5,348,504 A * 9/1994 Pierce et al. ..... 441/108
5,514,019 A * 5/1996 Smith ..... 2/311
6,036,562 A * 3/2000 Brown ..... 441/108
6,216,636 B1 * 4/2001 Butchko ..... 119/497

* cited by examiner

*Primary Examiner*—Gary L. Welch
(74) *Attorney, Agent, or Firm*—Freedman & Associates

(57) ABSTRACT

A tandem riding vehicle safety device is disclosed. The safety device comprises an elongate tension bearing member having a width sufficient for providing a reasonable force per unit area upon a tandem riding vehicle operator when engaged therewith and supporting a passenger of the tandem riding vehicle including a first end and a second end for, in use, being pulled about a front of an operator from both sides to releasably secure a passenger to the operator; a first handle connected to the member and a second handle connected to the member the handles for grasping by the passenger and for use in pulling of the elongate tension bearing member for providing tension therein; and absent a fastener proximate opposing ends of the member for coupling the member to form a closed loop.

7 Claims, 4 Drawing Sheets

SEAMOBILE SAFETY BELT

This application claims priority from Provisional Application No. 60/328,420 filed Oct. 12, 2001.

FIELD OF THE INVENTION

The field of invention relates to seamobile safety belt, and more particular pertains to a seamobile safety belt for manual grasping thereof by a passenger other than the driver of a seamobile.

BACKGROUND OF THE INVENTION

Safety belt structures for use with tandem riding vehicles have been provided in the prior art to permit a passenger of a motorcycle to grasp a handle arrangement mounted to a belt to be worn by a driver of the associated motorcycle. Unfortunately, the problems associated with tandem riders of a motorcycle, are different from those associated with tandem riding of a seamobile. For example, in a motorcycle accident, the rider and passenger are generally thrown clear of the motorcycle and have substantial resulting injuries. In seamobile operation, it is common to be thrown from the seamobile and end up in the water with little or no injury. This is part of what makes seamobiling so much fun.

Unfortunately, a passenger of a seamobile generally must secure themselves by holding on to the driver. In cases where a driver and passenger fall into the water, this may pose a safety risk with the potential of drowning for several reasons. Firstly, the passenger and operator of the seamobile are very close together when the passenger is directly secured to the operator. As such, when thrown it is more likely the two will collide. Also, because the passenger may not let go of the operator once in the water, the operator may be at risk of being pulled under and drowning.

Though an extrapolation of motorcycle seat belts to seamobiles may appear obvious, it is not so. The prior art motorcycle seat belts result in situations where the driver of the motorcycle has no control over the coupling between the driver and the passenger. For water sports, this results in a very hazardous situation and is therefore undesirable.

Examples of prior art devices for motorcycles may be found in U.S. Pat. No. 4,413,358 to Jimenez wherein a fixed buckle arrangement secures opposed ends of a first belt member thereto, wherein a second web portion mounted medially of the belt member captures a plurality of spaced handles in a fixed relationship relative to the belt member. Unfortunately, the belt is secured to the driver and as such, increases the risks outlined above if used with a seamobile. Once in the water, it is undesirable to be connected to loops that might become entangled or may be grasped by drowning victims during a time of panic.

U.S. Pat. No. 3,896,499 to Kelly sets forth a relatively wide belt for encircling outer garments of a driver of a vehicle, wherein vertical flexible loops are selectively secured and grasped by a rider of the vehicle that is positioned rearwardly of the driver. Unfortunately as noted above, the belt is secured to the driver and as such, increases the risks outlined above if used with a seamobile.

U.S. Pat. No. 4,396,013 to Hasslinger provides a flexible belt arrangement for encircling a mid-section of a driver of a tandemly seated vehicle, such as a motorcycle, utilizing a plurality of handles fixedly secured to the belt for grasping by a passenger. Unfortunately as noted above, the belt is secured to the driver and as such, increases the risks outlined above if used with a seamobile.

U.S. Pat. No. 3,840,902 to McNeill sets forth a safety belt for motorcycles utilizing a rearwardly positioned shock-absorbing cushion to minimize impact between a passenger and a driver of a motorcycle, as well as fixedly mounting a handle positioned to each side of the motorcycle. Unfortunately as noted above, the belt is secured to the driver and as such, increases the risks outlined above if used with a seamobile.

In U.S. Pat. No. 5,081,719 in the name of Donnelly, there is provided a motorcycle safety belt arrangement permitting relative repositioning of handle structure mounted to an associated belt.

As noted above, for use in water, it is very unsafe to maintain a connection between two people during a fall. For example, if the above-described inventions were used with a seamobile and the passenger was unable to swim, the passenger would hold on for dear life. This can easily compromise the safety of the seamobile operator and result in drowning. Therefore, the above-mentioned devices are ill suited to operation in naval situations.

It is an object of the present invention to provide a new and improved safety belt for use with seamobiles and the like that may be easily and efficiently manufactured and marketed.

SUMMARY OF THE INVENTION

In accordance with the invention there is provided a tandem riding vehicle safety device comprising:

an elongate tension bearing member having a width sufficient for providing a reasonable force per unit area upon a tandem riding vehicle operator when engaged therewith and supporting a passenger of the tandem riding vehicle including a first end and a second end for, in use, being pulled about a front of an operator from both sides to releasably secure a passenger to the operator; a first handle connected to the member and a second handle connected to the member, the handles for grasping by the passenger and for use in pulling of the elongate tension bearing member for providing tension therein; and absent a fastener proximate opposing ends of the member for coupling the member to form a closed loop.

In accordance with the invention there is further provided a flotation device comprising:

a flotation device for securing to a passenger of a tandem vehicle;

an elongate tension bearing member having a width sufficient for providing a reasonable force per unit area upon a tandem riding vehicle operator when engaged therewith and supporting a passenger of the tandem riding vehicle including a first end and a second end for, in use, being pulled about a front of an operator from both sides to releasably secure a passenger to the operator; a first handle connected to the member and a second handle connected to the member, the handles for grasping by the passenger and for use in pulling of the elongate tension bearing member for providing tension therein; and absent a high tension fastener for performing either of coupling the member to the operator of the vehicle and forming a closed loop about the operator of the vehicle to fasten the passenger to the operator.

BRIEF DESCRIPTION OF THE DRAWINGS

The invention will now be described with reference to the drawings wherein.

DETAILED DESCRIPTION OF THE INVENTION

Figure 1:
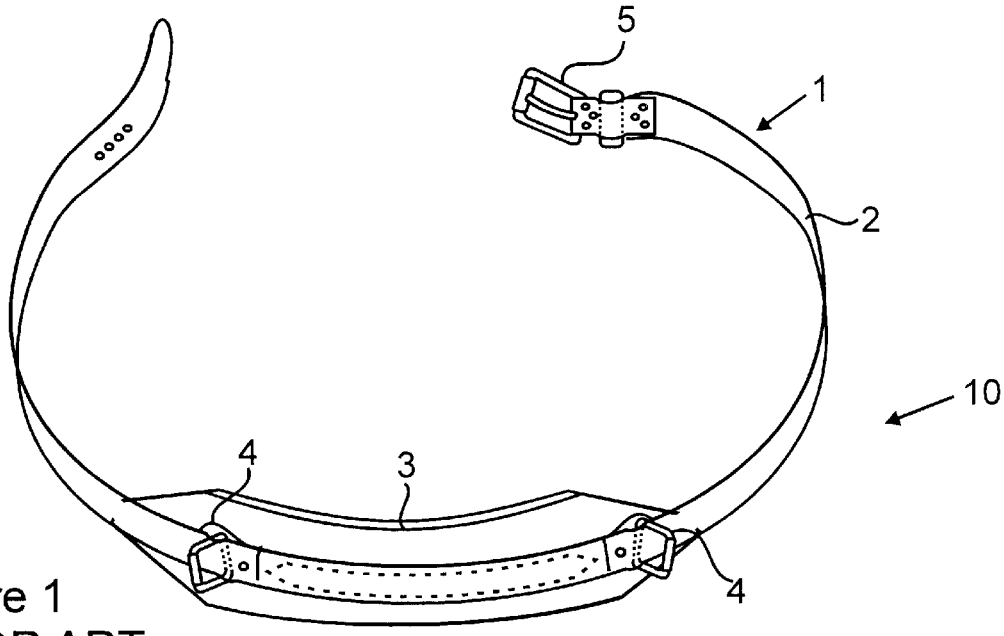
Figure 1 PRIOR ART
FIG. 1 is an isometric illustration of a prior art motorcycle safety belt arrangement.
Figure 2:
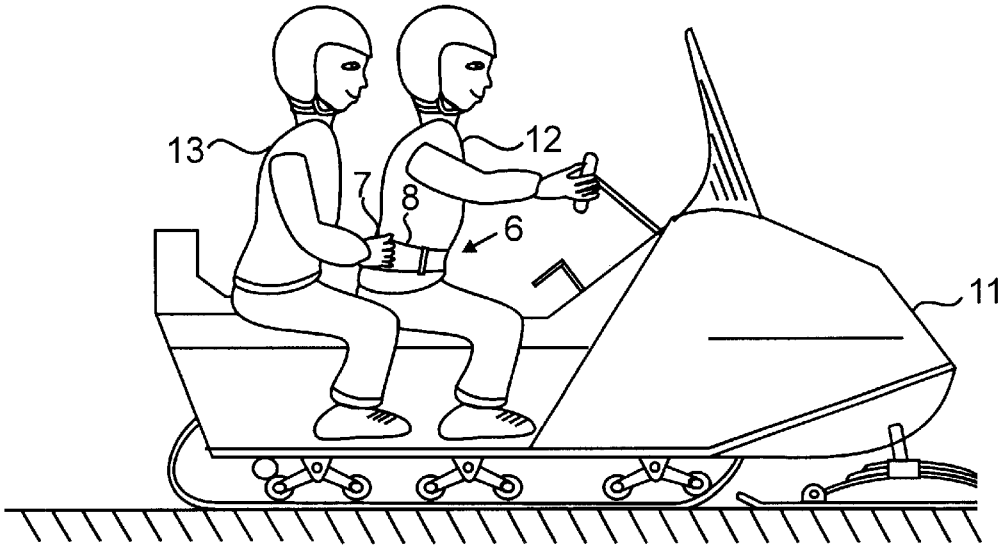
Figure 2 PRIOR ART
FIG. 2 is a further prior art example of a safety belt arrangement utilized in a vehicle employing tandem passenger seats.

FIG. 1 illustrates a prior art safety belt arrangement 1 for a motorcycle, wherein a flexible belt 2 includes an enlarged web 3 to capture a plurality of fixed handles 4 between the web and the belt structure, with the buckle portion 5 of the belt arranged for securement to a forward portion of an individual. FIG. 2 illustrates a further prior art safety belt structure 6, wherein a relatively wide belt 8 includes fixed handles 7 of flexible construction mounted to rear portions of the belt structure.

More specifically, the motorcycle safety belt apparatus 10 is typically mounted to a driver 12 of the tandem-riding vehicle 11 for manual grasping of a passenger 13. The safety belt structure 10 essentially comprises a flexible belt web defined by a finite length and formed of interwoven fiber of polymeric construction or alternatively of a natural flexible material, such as leather, defined by an interior surface coextensive with an exterior surface. The belt web is defined by a predetermined and fixed cross-sectional configuration, including a first end cooperative with a second end to permit adjustable securement of the first and second ends together in a rapid and easily operable manner. Further it should be noted that the first and second ends are arranged for securement about a back surface of an individual, as opposed to the forward portion of a driver's mid-section such that inadvertent disengagement of the first and second ends relative to one another maintains operative use of the belt structure and minimizes its disengagement from the driver.

Of course, fastening of a belt at the rearside of a driver, results in a belt over which the driver maintains little or no control. In the use of seamobiles, a potential source of injury to an operator is the passenger refusing to let go of the operator when they are thrown into the water thereby compromising the driver's safety and the driver's ability to swim. Of course, though this behaviour poses a danger to all involved and is not a best course of action, panic often causes frightened or drowning individuals to hold on and refuse to let go.

Water safety knowledge clearly indicates that holding a drowning victim with one's hands is undesirable since they may cause a rescuer harm or, even worse, to drown. It is preferable to rescue someone with a pole or a flotation device on a string. Only as a last resort should a professional water rescuer directly contact and retrieve a drowning person. If this is the case for water safety professionals, the warning should be all the more heeded by amateurs and thrill seekers.

For example, the belt shown in FIG. 1 is attached to the driver. Should the handle become caught while underwater, the driver would be maintained in a compromised position. Also, should the passenger be panicked, it is possible that the passenger will not release one of the handles resulting in the driver again having their safety compromised.

Another significant drawback of the prior art of FIG. 1 is that the operator of the motorcycle cannot detach the belt during operation of the motorcycle since the fasteners are at their back. Though, this is typically of little concern, during an accident or when in the water, should one handle be caught, the driver would be trapped potentially leading to his death.

Figure 3:
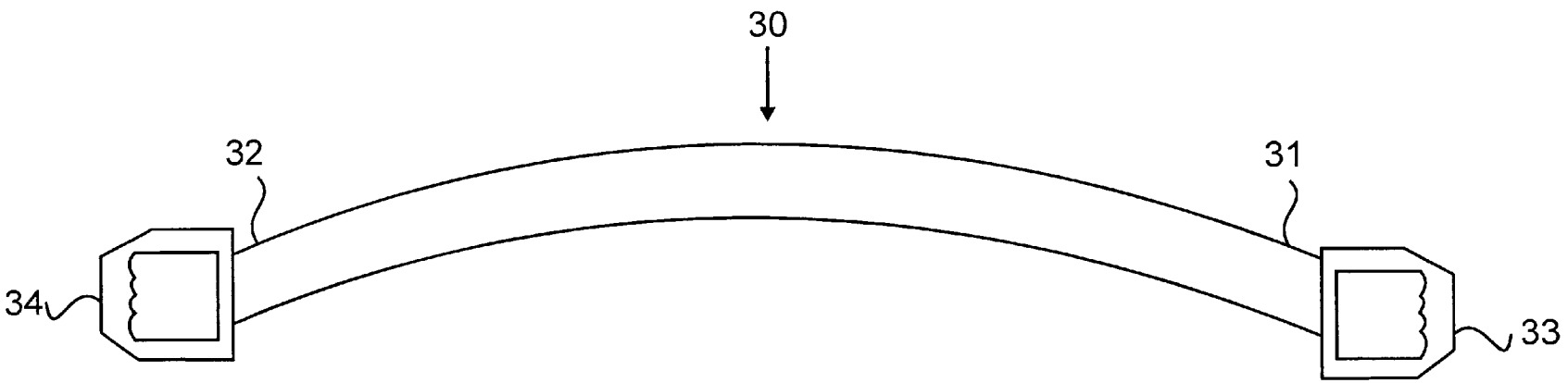
FIG. 3 is a view of a belt according to the invention for use with seamobiles.
Figure 4:
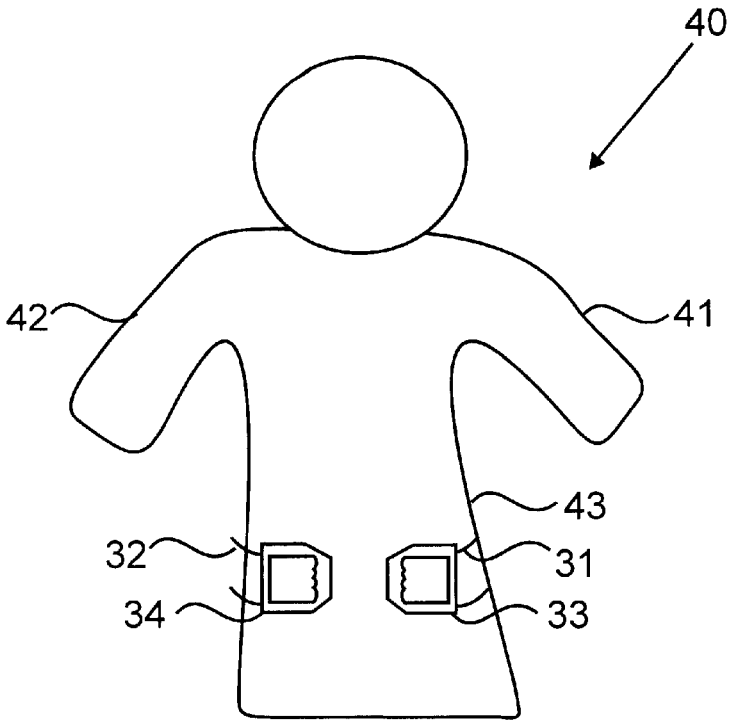
FIG. 4 is a view of the belt of FIG. 3 in operation.

Referring to FIG. 3, an improved belt 30 according to the invention is shown. The belt 30 has a first end 31 and a second end 32 each including grasping means in the form of handles 33 and 34. The belt 30 is absent a fastener to prevent its fastening to the operator of the seamobile. As such, in use, the belt 30 is placed about the front of the seamobile operator allowing the handles 33 and 34 to protrude below the arms 41 and 42 of the operator 40 at their back 43 as shown in FIG. 4.

A passenger on the seamobile grasps the handles in order to more comfortably remain seated and secured to the seamobile. Typically, it is generally desired that the handles be positioned about the rear mid-section of the driver in use, but may alternatively be positioned rearwardly thereof for convenient grasping by a passenger.

Should an unfortunate event such as an accident occur, releasing of one of the two handles results in no substantial linkage between the operator and the passenger allowing them each to be thrown free of each other. Advantageously, the safety device comprises adjusters for adjusting the location of the connection between handles and the non-separable elongate tension bearing member, the adjusters including a system for automatically releasing upon being exposed to a tension above a threshold tension. Similarly, the operator at anytime may choose to slide themselves out from the belt, when possible, in order to free themselves of the passenger; this typically will happen when the operator and passenger are both in the water. Also, significantly, it is difficult for an operator of the seamobile to become pinned by the belt since this would require pinning of both opposing ends of the belt at or about a same time.

Figure 5:
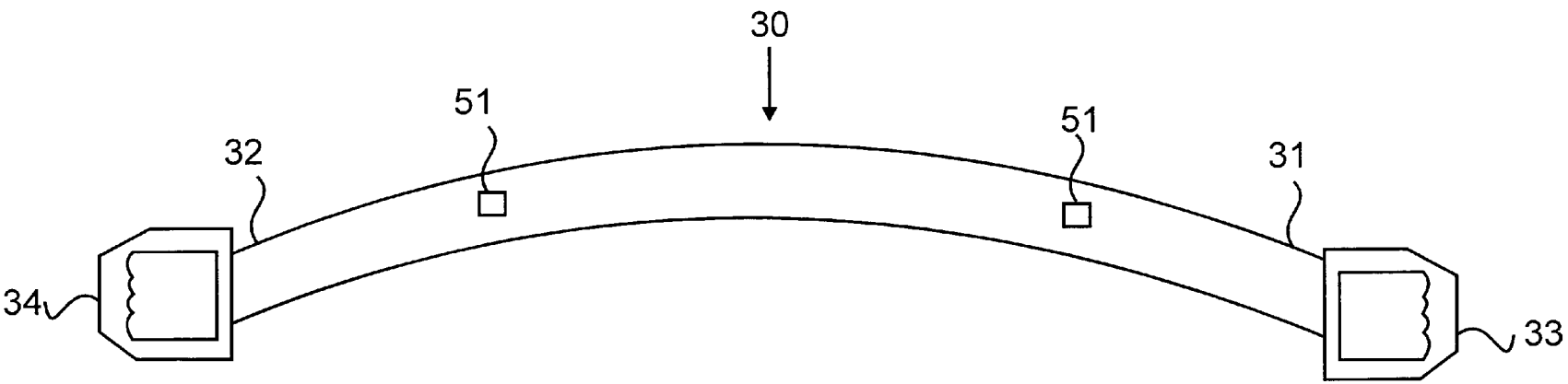
FIG. 5 is a view of another belt according to the invention for use with seamobiles.

Referring to FIG. 5, another seamobile belt is shown. Here, the belt 30 has a two Velcro® tabs 51 for securing to mating portions on the operator of the seamobile, preferably at the sides of the operator. The use of coupling provides comfort in releasing the seatbelt without losing of same. This is advantages during passenger changes or while waiting.

Though the above description refers to a seamobile belt, it is equally applicable to all tandem-riding vehicles such as snowmobiles, motorcycles, etc. For seamobiles, the advantages are apparent since there is a real risk of drowning should two people remain attached together. Of course, many of the snowmobiling deaths that occur in Canada and the United States relate to drowning when a snowmobile breaks through thin ice. In these situations, the above-described device is again advantageous.

Additionally advantageously, the device is useful in rescuing of passengers should potential drowning situations occur. For example, an operator grasps the device to pull a passenger to shore without requiring physical contact with the passenger. According to common water safety knowledge this is a relatively safe form of water rescue procedure for the passenger and for the rescuer.

Preferably, the seatbelt of the present invention is formed in a fashion that it floats. Otherwise, there is a potential to lose the belt each time a passenger falls from a seamobile.

More preferably, it is formed as a flotation assist device for use in water rescue or by someone who cannot swim well. As such, it is useful by the passenger, by the operator, by either the passenger or operator in saving the other and also by other water rescue personnel.

Figure 6:
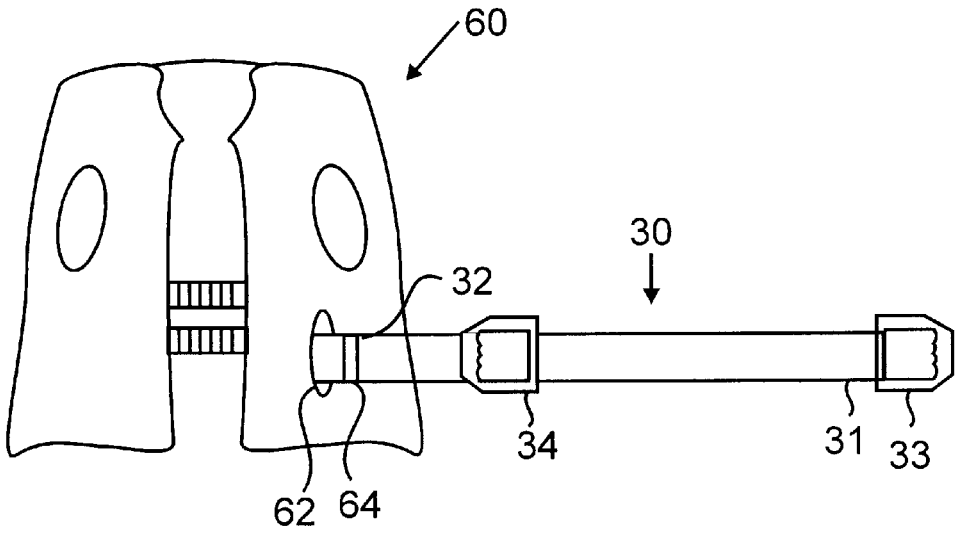
FIG. 6 is a view of another belt according to the invention integrated with a life preserver.

Referring to FIG. 6, shown is a flotation device in the form of a life jacket 60 including a strap 30 having two handles 33 and 34 for use in securing a passenger to an operator of a seamobile. Here, the strap 30 is stored within a pocket 62 of the life jacket 60 when not in use. Advantageously, this protects the passenger and the operator. Preferably, the strap 30 is not tightly secured to the life jacket 60 such that it comes free during a collision. In FIG. 6, this is accomplished by using a Velcro® connection 64 between the belt 30 and the pocket 62.

Of course, the handle 34 is optional and may be excluded when passenger comfort does not so require.

Further, in the use of motorcycles, snowmobiles and seamobiles, a potential source of injury is the passenger colliding with the driver during a safety related maneuver or during an accident, for example, when being thrown from the vehicle. The present invention reduces those risks due to the very loose coupling between operator and passenger.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tandem riding vehicle safety device comprising:

a non-separable elongate tension bearing member having a width sufficient for providing a reasonable force per unit area upon a tandem riding vehicle operator when engaged therewith and supporting a passenger of the tandem riding vehicle including a first end and a second end for, in use, being pulled about a front of an operator from both sides to releasably secure a passenger to the operator; a first handle connected to the first end of the member and a second handle connected to the second end of the member, the handles for grasping by the passenger and for use in pulling of the non-separable elongate tension hearing member for providing tension therein;

absent a fastener proximate opposing ends of the member for coupling the member to form a closed loop;

an adjuster for adjusting the location of the connection between the first handle and the non-separable elongate tension bearing member; and, another adjuster for adjusting the location of the connection between the second handle and the non-separable elongate tension hearing member;

wherein the other adjuster for adjusting the location of the connection between the second handle and the non-separable elongate tension bearing member includes a release for automatically releasing upon being exposed to a tension above a threshold tension.

2. A tandem riding vehicle safety device comprising:

a non-separable elongate tension bearing member having a width sufficient for providing a reasonable force per unit area upon a tandem riding vehicle operator when engaged therewith and supporting a passenger of the tandem riding vehicle including a first end and a second end for, in use, being pulled about a front of an operator from both sides to releasably secure a passenger to the operator; a first handle connected to the first end of the member and a second handle connected to the second end of the member, the handles for grasping by the passenger and for use in pulling of the non-separable elongate tension bearing member for providing tension therein;

absent a fastener proximate opposing ends of the member for coupling the member to form a closed loop; and, an adjuster for adjusting the location of the connection between the first handle and the non-separable elongate tension bearing member;

wherein the adjuster for adjusting the location of the connection between the first handle and the non-separable elongate tension hearing member includes a release for automatically releasing upon being exposed to a tension above a threshold tension.

3. A tandem riding vehicle safety device comprising:

a non-separable elongate tension bearing member having a width sufficient for providing a reasonable force per unit area upon a tandem riding vehicle operator when engaged therewith and supporting a passenger of the tandem riding vehicle including a first end and a second end for, in use, being pulled about a front of an operator from both sides to releasably secure a passenger to the operator; a first handle connected to the first end of the member and a second handle connected to the second end of the member, the handles for grasping by the passenger and for use in pulling of the non-separable elongate tension bearing member for providing tension therein;

absent a fastener proximate opposing ends of the member for coupling the member to form a closed loop; and, a releasable coupling for being coupled to an operator of the tandem vehicle in a releasable fashion, the releasable coupling for releasing upon experiencing tension above a threshold tension.

4. A tandem riding vehicle safety device comprising:

a non-separable elongate tension bearing member having a width sufficient for providing a reasonable force per unit area upon a tandem riding vehicle operator when engaged therewith and supporting a passenger of the tandem riding vehicle including a first end and a second end for, in use, being pulled about a front of an operator from both sides to releasably secure a passenger to the operator; a first handle connected to the first end of the member and a second handle connected to the second end of the member, the handles for grasping by the passenger and for use in pulling of the non-separable elongate tension bearing member for providing tension therein;

absent a fastener proximate opposing ends of the member for coupling the member to form a closed loop; and, a releasable coupling for being coupled to an operator of the tandem vehicle in a releasable fashion, the releasable coupling for releasing upon experiencing tension above a threshold tension, wherein the releasable coupling is formed of hook and loop fasteners.

5. A method of securing a passenger of a tandem-riding vehicle comprising the steps of:

providing a non-separable length of material about a front of a tandem riding vehicle operator;

grasping the material proximate each of the opposing ends of the material by a passenger of the tandem-riding vehicle, wherein the release of one end of the material results in a release of the coupling between the passenger and the operator of the tandem-riding vehicle.

6. A method according to claim 5 wherein the material includes two handles and wherein the step of grasping the material includes the step of grasping the two handles.

7. A method according to claim 6, wherein the material includes a floatable material.

* * * * *